US005664702A

United States Patent [19]

Beauchamp

[11] Patent Number: 5,664,702

[45] Date of Patent: Sep. 9, 1997

[54] FOOT OPERATED BEER KEG PRESSURIZER

[76] Inventor: Christopher E. Beauchamp, 2327 River Park Cir., Suite 1411, Orlando, Fla. 32817

[21] Appl. No.: 672,117

[22] Filed: Jun. 27, 1996

[51] Int. Cl.[6] ..... B67D 5/06

[52] U.S. Cl. ..... 222/179; 222/400.8; 137/212

[58] Field of Search ..... 137/212; 222/179, 222/397, 400.7, 400.8, 209, 189.09, 189.11; 251/295

[56] References Cited

U.S. PATENT DOCUMENTS

| | | | |
|---|---|---|---|
| 206,825 | 8/1878 | Prindle | 222/400.8 |
| 433,426 | 7/1890 | Tucker | 222/179 |
| 2,628,744 | 2/1953 | Mowbary | 222/179 |
| 2,812,117 | 11/1957 | Butkus et al. | 222/189.09 |
| 3,447,558 | 6/1969 | Cserny . | |
| 3,464,591 | 9/1969 | Nicola . | |
| 3,498,313 | 3/1970 | Belich . | |
| 3,563,424 | 2/1971 | Johnston . | |
| 4,094,335 | 6/1978 | Haensch . | |
| 4,180,189 | 12/1979 | Zurit et al. | 137/212 |
| 4,291,821 | 9/1981 | Nezworski | 137/212 |
| 4,651,902 | 3/1987 | Hobbs et al. | 222/179 |
| 4,728,010 | 3/1988 | Johnston | 222/400.8 |

*Primary Examiner*—Philippe Derakshani
*Attorney, Agent, or Firm*—Merrill N. Johnson

[57] ABSTRACT

A foot-operated beer-keg pressurizer has a floor-based foot pump (1) with which air is pumped through a pressure tube (17) from a variably remote beer keg (2) to a keg faucet (9) that is attachable to conventional beer-keg connectors (6). A beer tube (8) extended from the keg faucet in the variably remote beer keg has a beer tap (7) that is preferably a squeeze or push-button type. Foot operation of the floor-based foot pump by a user or by a separate person frees both hands of a user for filling beer-drinking containers.

5 Claims, 1 Drawing Sheet

FOOT OPERATED BEER KEG PRESSURIZER

BACKGROUND OF THE INVENTION

1. Field of the Invention

This invention relates to pressurizers for beer kegs and in particular to a foot-operated pressurizer for beer kegs.

2. Description of Related Art

Previous beer-keg pressurizers for serving tap beer have been hand operative or pressure-tank operative. Pressure in space above beer in kegs forces the beer out through a pipe that reaches down into the beer.

Hand operation requires one hand to operate a pump and the other to hold a tap that usually is not stationary in beer-party conditions. This prevents filling a glass held with one hand and usually requires two people for filling a beer glass or mug. It obstructs functioning freely with both hands for filling beer glasses, drinking beer and other partying during festive conditions where beer kegs are used most often.

Pressure tanks and frequently motor-operated air pumps are applicable mostly for long-term use at taverns and various types of club houses. They inject carbon dioxide gas into beer kegs for a two-fold purpose of (a) pressurizing the beer keg and (b) creating a thick head of foam on top of beer in drinking containers to impress customers.

A large market exists for one-time or short-term purchase of beer in kegs. A deposit is paid on the kegs, a hand pump with a keg-outlet fitting and frequently a cooler tub. It is a party market where hand-free use is highly desirable and a thick head of foam does not induce customer traffic.

Prior art that is different but related is described in the following patent documents: U.S. Pat. No. 4,094,135, issued to Haensch on Jun. 15, 1978; U.S. Pat. No. 3,563,424, issued to Johnston on Feb. 16, 1971; U.S. Pat. No. 3,498,313, issued to Belich on Mar. 3, 1970; and U.S. Pat. No. 3,464,591, issued to Nicola on Sep. 2, 1969.

SUMMARY OF THE INVENTION

In light of need for a more convenient beer-keg pressurizer, objects of this invention are to provide a foot-operated beer-keg pressurizer which:

- Is foot-operative to free both hands for filling beer-drinking containers and engaging in other party activities;
- Requires only one person for filling a beer mug or glass from a beer keg with a manual pressurizer;
- Has a keg fitting that can be positioned firmly, reliably and conveniently into standardized quick-disconnect outlets of conventional beer kegs;
- Is one-foot operative from a standing or sitting position without bodily destabilization;
- Can be attached to variously remote kegs and operated from a different position; and
- Is inexpensive, long-lasting, convenient to handle and aesthetically pleasing.

This invention accomplishes these and other objectives with a foot-operated beer-keg pressurizer having a floor-based foot pump with which air is pumped through a pressure tube from a variably remote beer keg to a keg faucet that is attachable to conventional beer-keg connectors. A beer tube extended from the keg faucet in the variably remote beer keg has a beer tap that is preferably a squeeze or push-button type. Foot operation of the floor-based foot pump by a user or by a separate person frees both hands of a user for filling beer-drinking containers.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
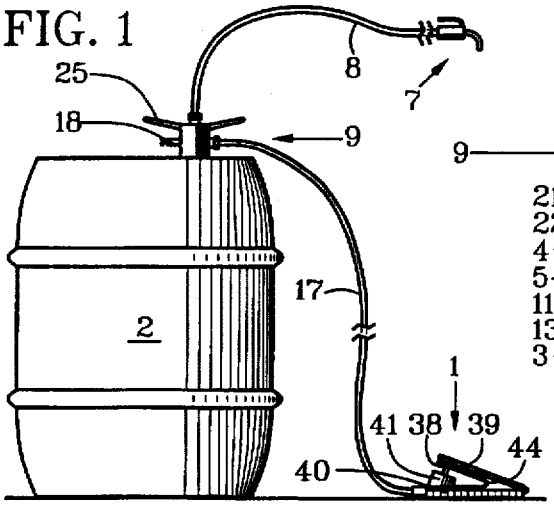
FIG. 1 is an elevation view.
Figure 2:
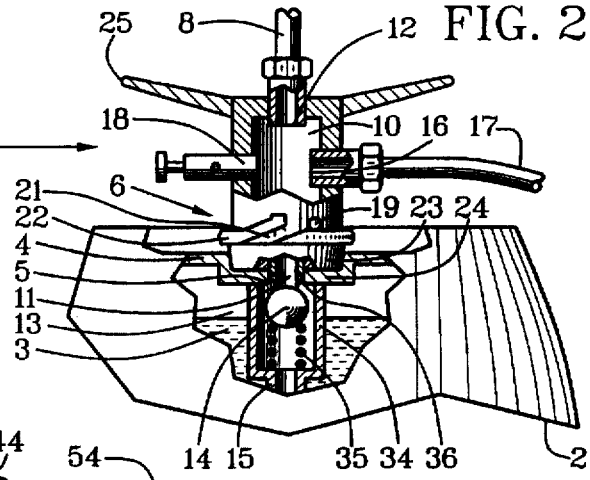
FIG. 2 is a partially cutaway expanded fragmentary view of a keg faucet attached to a keg-faucet connector.

Reference is made first to FIGS. 1–2. A floor-based foot pump 1 is sized, shaped and structured to pump air into a beer keg 2 under pressure between a top surface of beer 3 and a bottom surface of a keg-aperture wail 4 containing a closeable keg aperture 5 having a keg-faucet connector 6.

The beer keg 2 is a conventional type used in the beer industry for distributing beer to be dispensed as tap beer from a beer tap 7 on a distal end of a beer tube 8 through which beer is forced to flow as a result of air pressure or other gas pressure in the beer keg 2. Commercial retailers and other long-term dispensers of tap beer, such as taverns, clubs and bars, usually have an electrical pump for pressurizing beer kegs 2. Many also employ carbon dioxide under pressure in a tank for generating gas bubbles that form a thick head of foam on tops of beer in beer glasses and mugs. Some use either the electric pump or the pressure tank separately.

Intermittent users and short-term users of beer kegs 2 comprise a large portion of the market for tap beer. The kegs 2 of beer 3 is sold to the intermittent and short-term users through liquor stores and, where legal, through grocery stores and liquor departments of supermarkets. The same kegs 2 or slightly larger ones with the same keg-faucet connectors 6 are used for intermittent and short-term users and for commercial and long-term users. Instead of an electrical pump and/or a pressure tank, a hand pump on a hand-pump faucet of various types is used by the intermittent and short-term users. Many retailers of tap beer with relatively low sales volume also use the hand-pump faucet.

Some short-term users have their own hand-pump faucets. Usually, however, dispensers of beer in kegs 2 supply them and require a deposit that is much larger than a deposit that is required also for the kegs 2 and other tap-beer paraphernalia.

Replacing cumbersome and inconvenient hand-pump faucets with a keg faucet 9 that provides hands-free use is an objective of this invention. Party-goers, club members, bar customers and others will be able to tap a remote keg 2 of beer 3 at their own table or be served easily by others as desired. Many retailers now using electric pumps and/or pressure tanks can switch to the more convenient keg faucet 9 with the floor-based foot pump 1. It can be made to use either the same keg-faucet connector 6 as for hand-pump faucets, electric pumps and/or pressure tanks or to use a specially designed keg-faucet connector 6 if found economically advantageous. Moreover, it is safer and less expensive than electric pumps and/or pressure tanks.

The beer tap 7 has an outlet valve that is a conventional type represented by a handle with which it is operated on a top portion of the beer tap 7. An outlet aperture at a distal end of the beer tap also is a conventional type that is not shown separately because of its conventional construction.

The keg faucet 9 has a fluid conveyance 10 in fluid communication between a beer inlet 11 and a beer outlet 12. The beer inlet 11 of a keg faucet 9 that is attached to the keg-faucet connector 6 is in fluid communication with an internal volume 13 of the beer keg 2 by way of passage by a keg valve 14 and through a keg tube 15 into the beer 3 where air under pressure from the fluid conveyance 10 can rise to a top of the beer 3 and force the beer 3 out through the beer inlet 11 and the closable keg aperture 5. Air pressure is conveyed to the fluid conveyance 10 through a pressure-tube inlet 16 that is in fluid communication between the floor-based foot pump 1 and the pressure-tube inlet 16 through a pressure tube 17.

A pressure-relief valve 18 can be provided to relieve pressure in the keg 2 when desired to disconnect the keg faucet 9 or to store the keg 2 for an extended period of time without internal pressure. A pressure-relief valve 18 is not essential, however, because pressure can be released by slight loosening of the keg faucet 9 in the keg-faucet connector 6. Some present hand-pump faucets have pressure-relief valves and some do not.

Figure 3:
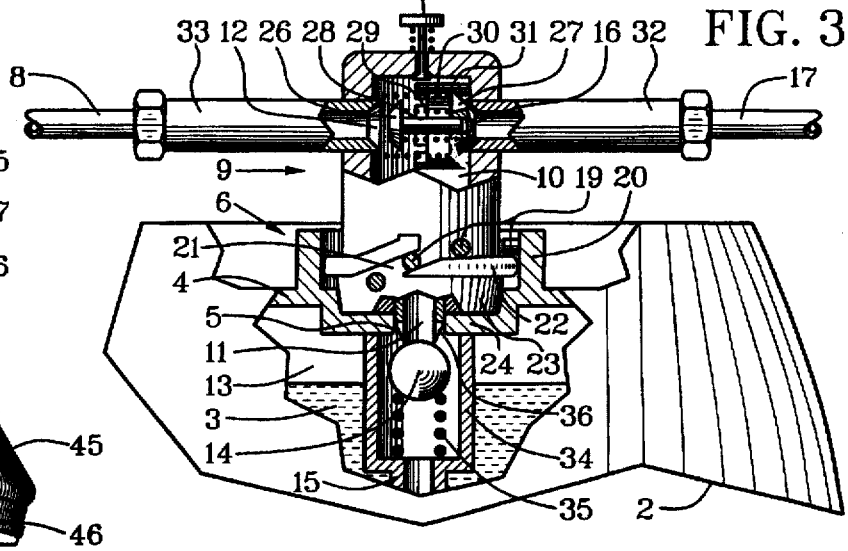
FIG. 3 is an alternative embodiment of the FIG. 2 illustration with a valved inlet and outlet into a keg faucet.

Referring to FIGS. 2–3, the keg-faucet connector 6 has a quick-disconnect boss 19 that is extended from a connector mount 20 and slides first in a thread slot 21 in a quick-disconnect faucet thread 22 when the keg faucet 9 is positioned in the keg-faucet connector 6 and rotated a few degrees. In FIG. 3, the quick-disconnect boss 19 is represented as a crosshatched circle as it enters and passes through the thread slot 21. After passing through the thread slot 21, the quick-disconnect boss 19 is positioned on a designedly horizontal or non-sloping top of the quick-disconnect faucet thread 22 where it is shown extended inwardly from the connector mount 20 in locked-sealing contact of a seal surface of a faucet seal 23 and a seal surface of a connector seal 24.

Positioning and rotation of the keg faucet 9 in the keg-faucet connector 6 is accomplished with the FIG. 2 embodiment by hand-grasping and hand-manipulation of faucet handles 25.

In FIG. 3, an embodiment of the keg faucet 9 has a beer outlet 12 and a pressure-tube inlet 16 in line concentrically. This allows in-line positioning of a beer-outlet valve 26 and a pressure-tube-inlet valve 27 in order to operate the beer-outlet valve 26 by actuation of the pressure-tube-inlet valve 27. The beer-outlet valve 26 can have a valve stem 28 that is preferably reciprocal in the pressure-tube-inlet valve 27. Also, the beer-outlet valve 26 can be attached to the pressure-tube-inlet valve 27 with a beer-outlet-valve spring 29 as shown. Closing actuation of the pressure-tube-inlet valve 27 against opposition to air pressure from the pressure-tube inlet 16 is provided by a pressure-tube spring 30. Concentric travel of the pressure-tube-inlet valve 27 can be assured by travel of a sleeve of the pressure-tube-inlet valve 27 in a valve-guide sleeve 31.

Preferably the beer-outlet-valve spring 29 is shorter and more resistant than the pressure-tube spring 30. This allows the pressure-tube-inlet valve 27 to be actuated quickly and easily to close the beer-outlet valve 26 in addition to opening the pressure-tube-inlet valve 27 in response to air pressure from the pressure-tube inlet 16. Larger diameter of these springs with the same wire diameter causes the desired higher pressure of the beer-outlet-valve spring 29.

Optionally, the valve stem 28 can be attached rigidly to the pressure-tube-inlet valve 27 with slightly less speed and efficiency in preventing air from entering the beer tube 8 when air is being pumped from the floor-based foot pump 1. Entry of beer into the pressure tube 17 when not operating the floor-based foot pump 1 at a lower position than the keg faucet 9 can be arrested by the pressure-tube-inlet valve 27 separately. Optionally also, the beer-outlet valve 26 can be omitted if not desired to prevent entry of air into the beer tube 8 when pressuring the keg 2.

Further optionally, an inlet pipe 32 for air pressure and an outlet pipe 33 for beer 3 can have sufficient strength and rigidity for use as handles for the keg faucet 9.

The keg faucets 9 and the keg-faucet connectors 6 illustrated in FIGS. 2–3 are not drawn to scale. Nor are the keg-faucet connectors 6 shown exactly as manufactured differently by various manufacturers. Instead, the keg-faucet connectors 6 in particular are represented with functional components in working relationship of parts that are variously common to most keg-faucet connectors 6. Conventional keg-faucet connectors 6 generally have some form of a connector mount 20 from which a quick-disconnect boss 19 is extended horizontally. The boss 19 has various shapes and sizes and the connector mount 20 can be a separate ring or a structural portion of a connector housing 34 which houses the keg valve 14, a keg-valve spring 35, the closable keg aperture 5 and various types and sizes of keg tubes 15.

Usually, beer kegs 2 are pressurized with carbon dioxide or air prior to commercial distribution in order to seal the keg valve 14 against a sealing surface of the closable keg aperture 5 prior to a slight pressure that occurs from vaporization of alcohol in the beer. The keg valve 14 is pushed inwardly or down against the keg-valve spring 35 with a valve-relief extension 36 from the faucet seal 23. The valve-relief extension 36 can be a tubular member with serrations or other means for allowing passage of beer 3 through the beer inlet 11 while also pushing the keg valve 14 away from a keg-valve seat at the closable keg aperture 5. It is after dissipation of original pressure in the keg 2 that pressurization of the keg 2 is required to pump beer 3 from the keg 2.

Figure 6:
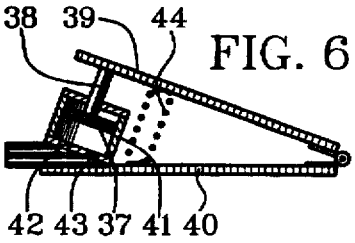
FIG. 6 is a partially cutaway side view of a piston type of foot pump.

Referring to FIGS. 1 and 6, a floor-based foot pump 1 can be a piston type with a piston 37 operated by a piston shaft 38 attached to a pump pedal 39 that is hinged to pump base 40. Air enters a cylinder 41 through a one-way inlet-valved aperture 42 and exits through a one-way outlet-valved aperture 43. The pressure tube 17 is connected to the one-way outlet-valve aperture 43. A pump spring 44 having contraction resistance is positioned with contraction resistance to downward travel of the pump pedal 39 and with resistance to pressure-outlet travel of the piston 37. The piston 37 and the cylinder 41 can be variously upright and variously attached to the pump pedal 39 and the pump base 40. Optionally also, the pump pedal 39 can be omitted for direct foot operation of the piston shaft 38 that can be variously covered. Further optional, the entire cylinder 41 and piston shaft 38 can be covered with a resilient shroud. The pump spring 44 can be either a leaf type as depicted in FIG. 1 or a coil type as depicted in FIG. 6.

Figure 4:
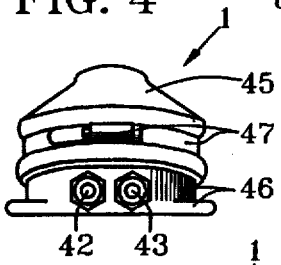
FIG. 4 is a front elevation view of cup type of foot pump.
Figure 5:
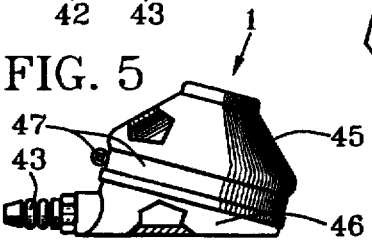
FIG. 5 is a partially cutaway side view of a cup type of foot pump.

Referring to FIGS. 4–5, the floor-based pump 1 can be a cup type with a rubberlike cup 45 attached to a cup-pump base 46 with an attachment means such as a hose connector 47. The one-way inlet-valved conveyance 42 and one-way outlet-valved conveyance 43 can be extended from the cup-pump base 46 with a working relationship as described in relation to FIGS. 1 and 6.

Figure 7:
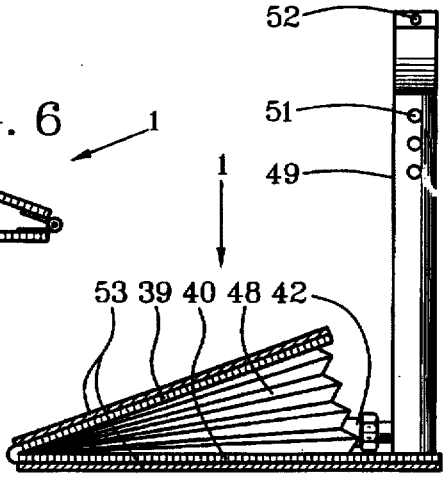
FIG. 7 is a side elevation view of a bellows type of foot pump with a clean-air conveyance.
Figure 8:
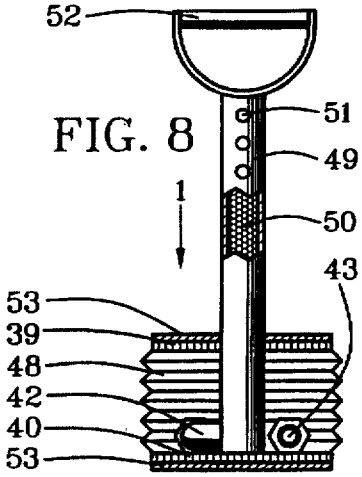
FIG. 8 is a partially cutaway front view of the FIG. 7 illustration.

Referring to FIGS. 7–8, the floor-based foot pump 1 can be a bellows type with a pleated bellows 48 operable between a pump pedal 39 and a pump base 40. As for other types of pumps, the one-way inlet-valved conveyance 42 and one-way outlet-valved conveyance 43 can be extended from the pleated bellows 48 with a working relationship as described in relation to FIGS. 1 and 6.

Optional for all types of floor-based foot pumps 1 can be a clean-air conveyance 49 in fluid communication with the one-way inlet-valved conveyance 42 as depicted in FIGS. 7–8. The clean-air conveyance 49 can contain an air filter 50 as an additional option for particularly dusty conditions such as occur frequently near dance floors where tap beer is served. A clean-air conveyance 49 can have inlet orifices 51 in side walls to prevent dropping of particles into it and can have a pump handle 52 for ease of handling and operation. A nonskid surface 53 can be provided on bottoms of pump bases 40 and on tops of pump pedals 39.

The floor-based foot pump 1 can be operated with either a user's toe or heel portion of their foot. Some users may prefer heel operation in order to maintain balance by toe contact with a floor. Some will use a toe for standing operation and a heel for sitting operation or vice versa.

It is foreseeable that conventional keg-faucet connectors 6 will change from time-to-time. Consequently, this invention is made adaptable to beer-keg connectors or keg-faucet connectors 6 that may be designed with forseeable types of quick-disconnect attachments.

Referring further to FIGS. 1–3, a top pressure relief valve 54 can be positioned in fluid communication with fluid conveyance 10 when inlet pipe 32 and outlet pipe 33 are employed. The inlet pipe 32 and the outlet pipe 33 may be used in lieu of faucet handles 25 in this embodiment.

A new and useful foot-operated beer-keg pressurizer having been described, all such modifications, adaptations, substitutions of equivalents, combinations of parts, pluralities of parts, applications and forms thereof as described by the following claims are included in this invention.

What is claimed is:

1. A foot-operated beer-keg pressurizer comprising:

a floor-based foot pump that is sized, shaped and structured to pump air into a beer keg under pressure within a beer keg having a keg wall containing a closable keg aperture;

the closable keg aperture having a keg-faucet connector;

keg faucet that is sized, shaped and structured to be attached to the keg-faucet connector;

a beer inlet and a beer outlet in the keg faucet;

a faucet conveyance in fluid communication between the beer inlet and the beer outlet;

a beer inlet of a faucet attached to the keg-faucet connector being in fluid communication with an internal volume of the beer keg;

a pressure-tube inlet in fluid communication with the faucet conveyance in the keg faucet;

a one-way inlet-valved aperture and a one-way outlet-valved aperture in the floor-based foot pump;

a pressure tube in fluid communication between the one-way outlet-valved aperture in the floor-based foot pump and the pressure-tube inlet in the keg faucet;

a beer tap having an outlet valve and an outlet aperture;

and a beer tube in fluid communication between the beer outlet in the keg faucet and the beer tap wherein the floor-based foot pump is a cylindrical type of pump having a pump piston operable in a pump cylinder in a designedly upright position on a pump base;

a pump pedal is hinged to the pump base and inclined obliquely from a hinge axis to a position of operable contact with a movable portion of the cylindrical type of pump vertically above the pump cylinder and pump piston;

the pump pedal is sized, shaped and structured for being pressed downwardly for operation of the floor-based foot pump by a desired portion of a user's foot; and a pump spring having contraction resistance is positioned with contraction resistance to downward travel of the pump pedal and with resistance to pressure-outlet travel of the pump piston in the pump cylinder.

2. A foot-operated beer-keg pressurizer comprising:

a floor-based foot pump that is sized, shaped and structured to pump air into a beer keg under pressure within a beer keg having a keg wall containing a closable keg aperture;

the closable keg aperture having a keg-faucet connector;

a keg faucet that is sized, shaped and structured to be attached to the keg-faucet connector;

a beer inlet and a beer outlet in the keg faucet;

a faucet conveyance in fluid communication between the beer inlet and the beer outlet;

a beer inlet of a faucet attached to the keg-faucet connector being in fluid communication with an internal volume of the beer keg;

a pressure-tube inlet in fluid communication with the faucet conveyance in the keg faucet;

a one-way inlet-valved aperture and a one-way outlet-valved aperture in the floor-based foot pump;

a pressure tube in fluid communication between the one-way outlet-valved aperture in the floor-based foot pump and the pressure-tube inlet in the keg faucet;

a beer tap having an outlet valve and an outlet aperture;

and a beer tube in fluid communication between the beer outlet in the keg faucet and the beer tap wherein the floor-based foot pump is a cylindrical type of pump having a pump piston operable in a pump cylinder in a designedly upright position on a pump base;

a pump pedal is hinged to the pump base and inclined obliquely from a hinge axis to a position of operable contact with a movable portion of the cylindrical type of pump vertically above the pump cylinder and pump piston;

the pump pedal is sized, shaped and structured for being pressed downwardly for operation of the floor-based foot pump by a desired portion of a user's foot; and a pump spring having contraction resistance is positioned with contraction resistance to downward travel of the pump pedal and with resistance to pressure-outlet travel of the pump piston in the pump cylinder and a clean-air conveyance in fluid communication with the one-way inlet-valved aperture in the floor-based foot pump which is sized, shaped and structured as a design portion of a pump handle that is extended upwardly from the floor-based foot pump; and the clean-air conveyance has an inlet aperture positioned above the floor.

3. A foot-operated beer-keg pressurizer comprising:

a floor-based foot pump that is sized, shaped and structured to pump air into a beer keg under pressure within a beer keg having a keg wall containing a closable keg aperture;

the closable keg aperture having a keg-faucet connector;

a keg faucet that is sized, shaped and structured to be attached to the keg-faucet connector;

a beer inlet and a beer outlet in the keg faucet;

a faucet conveyance in fluid communication between the beer inlet and the beer outlet;

a beer inlet of a faucet attached to the keg-faucet connector being in fluid communication with an internal volume of the beer keg;

a pressure-tube inlet in fluid communication with the faucet conveyance in the keg faucet;

a one-way inlet-valved aperture and a one-way outlet-valved aperture in the floor-based foot pump;

a pressure tube in fluid communication between the one-way outlet-valved aperture in the floor-based foot pump and the pressure-tube inlet in the keg faucet;

a beer tap having an outlet valve and an outlet aperture; and a beer tube in fluid communication between the beer outlet in the keg faucet and the beer tap wherein the keg-faucet connector has at least one quick-disconnect connector boss that is extended inwardly from a connector mount on the keg-faucet connector;

the keg faucet has at least one quick-disconnect faucet thread that is extended outward radially from a connector portion of the keg faucet;

the quick-disconnect faucet thread is sloped circumferentially;

the quick-disconnect faucet thread is sized and shaped to receive the quick-disconnect connector boss;

the keg faucet has a faucet seal with a seal surface that is positioned in sealing contact with a connector seal having a mating seal surface on the connector seal, such that sealing contact of a seal surface on the faucet seal with a mating seal surface on the connector seal is caused by cam action of the quick-disconnect faucet thread on the quick-disconnect connector boss with rotation of the keg faucet; and the quick-disconnect faucet thread has a designedly non-sloping section with which the quick-disconnect connector boss is contained for locked-sealing contact of seal surfaces of the faucet seal and the connector seal.

4. A foot-operated beer-keg pressurizer comprising:

a floor-based foot pump that is sized, shaped and structured to pump air into a beer keg under pressure within a beer keg having a keg wall containing a closable keg aperture;

the closable keg aperture having a keg-faucet connector;

a keg faucet that is sized, shaped and structured to be attached to the keg-faucet connector;

a beer inlet and a beer outlet in the keg faucet;

a faucet conveyance in fluid communication between the beer inlet and the beer outlet;

a beer inlet of a faucet attached to the keg-faucet connector being in fluid communication with an internal volume of the beer keg;

a pressure-tube inlet in fluid communication with the faucet conveyance in the keg faucet;

a one-way inlet-valved aperture and a one-way outlet-valved aperture in the floor-based foot pump;

a pressure tube in fluid communication between the one-way outlet-valved aperture in the floor-based foot pump and the pressure-tube inlet in the keg faucet;

a beer tap having an outlet valve and an outlet aperture; and a beer tube in fluid communication between the beer outlet in the keg faucet and the beer tap;

a beer-outlet valve in the beer outlet in the keg faucet;

a pressure-tube-inlet valve in the pressure-tube inlet in the keg faucet which comprises a one-way valve having valve-closing contact with the beer-outlet valve in the beer outlet in the keg faucet by opening action of the pressure-tube-inlet valve from actuation of floor-based foot pump and the beer outlet and the pressure-tube inlet are in line concentrically;

a pressure-tube spring is positioned in spring resistance to opening of the pressure-tube-inlet valve;

a beer-outlet-valve spring having spring-expansion force between the pressure-tube inlet valve and the beer-outlet valve is positioned in contact with the pressure-tube inlet valve and the beer-outlet valve; and the beer-outlet-valve spring has a length of spring-expansion force that is shorter than a valve-closing distance between the pressure-tube-inlet valve and the beer-outlet valve, such that (a) minimal-to-maximal opening of the pressure-tube-inlet valve closes the beer-outlet valve by pushing against it, (b) the pressure-tube spring closes the pressure-tube-inlet valve in the absence of pressure in the pressure tube and (c) closing of the pressure-tube-inlet valve pulls the beer-outlet-valve spring to open the beer-outlet valve in order to prevent entry of air into the beer tube when pressurizing the beer keg and in order to prevent entry of beer into the pressure tube after the beer keg has been pressurized.

5. A foot-operated beer-keg pressurizer as described in claim 4 wherein:

the beer outlet and the pressure-tube inlet are rigid pipes in a T-formation handle that is sized, shaped and structured for transporting the keg faucet and beer kegs to which it is attached firmly.

* * * * *